US011871832B2

(12) United States Patent
Roh

(10) Patent No.: US 11,871,832 B2
(45) **Date of Patent: *Jan. 16, 2024**

(54) MODULAR PALETTE

(71) Applicant: ELC MANAGEMENT LLC, Melville, NY (US)

(72) Inventor: Yeon Jung Roh, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/832,299

(22) Filed: Jun. 3, 2022

(65) Prior Publication Data

US 2022/0400831 A1 Dec. 22, 2022

Related U.S. Application Data

(62) Division of application No. 17/349,387, filed on Jun. 16, 2021.

(51) Int. Cl.
*A45D 33/00* (2006.01)

(52) U.S. Cl.
CPC ..... *A45D 33/006* (2013.01); *A45D 2033/001* (2013.01); *A45D 2200/052* (2013.01)

(58) Field of Classification Search
CPC .. A45C 11/008; A45D 33/006; A45D 33/008; A45D 33/18; A45D 33/24;
(Continued)

(56) References Cited

U.S. PATENT DOCUMENTS 5,005,697 A 4/1991 Jimbo et al.
5,092,354 A * 3/1992 Pacelli, Jr. ..... A45D 40/22 206/823

(Continued)

FOREIGN PATENT DOCUMENTS

FR 2998147 A1 * 5/2014 ..... A45C 13/1069
FR 3009675 A1 2/2015

(Continued)

OTHER PUBLICATIONS

Grapefruit maiden purchasing MAC nine-color eyeshadow palette 5.85g; Date: Nov. 28, 2020; Retrieved from the Internet at: <http://www.ruten.com.tw/item/show?22048125817707>.

(Continued)

*Primary Examiner* — Cris L. Rodriguez
*Assistant Examiner* — Luis M Ruiz Martin
(74) *Attorney, Agent, or Firm* — MARSHALL, GERSTEIN & BORUN LLP

(57) ABSTRACT

A modular cosmetic product is provided that includes a container defining a cavity, an insert, a bezel, and a cosmetic product pan. The insert is adapted to be disposed within the cavity of the container and is at least partially constructed from a magnetic material. The bezel is also adapted to be at least partially disposed within the cavity of the container, and includes at least one opening. The cosmetic product pan is adapted to retain a cosmetic product and is at least partially disposed within the at least one opening of the bezel. The cosmetic product pan is at least partially constructed from a magnetic material such that it is urged towards the insert.

1 Claim, 18 Drawing Sheets

(58) Field of Classification Search
CPC ..... A45D 33/26; A45D 40/22; A45D 40/24; A45D 2200/052; A45D 40/0068; A45D 33/00; A45D 2200/05; A45D 33/22; Y10S 206/804
USPC ..... 132/293; 206/804
See application file for complete search history.

(56) References Cited

U.S. PATENT DOCUMENTS

| | | | | |
|---|---|---|---|---|
| 11,006,731 | B2 | 5/2021 | Dunton et al. | |
| 2003/0150470 | A1 | 8/2003 | Phue | |
| 2010/0031971 | A1 | 2/2010 | Ha | |
| 2011/0253167 | A1 | 10/2011 | Shteysel | |
| 2013/0133686 | A1 | 5/2013 | Shteysel | |
| 2014/0299151 | A1* | 10/2014 | Stroud | A45D 33/008 132/315 |
| 2021/0078784 | A1 | 3/2021 | Huang | |
| 2022/0202166 | A1 | 6/2022 | Plain | |

FOREIGN PATENT DOCUMENTS

| | | | | |
|---|---|---|---|---|
| JP | 2002253336 | A | * | 9/2002 |
| KR | 101232712 | B1 | * | 2/2013 |
| KR | 101347659 | B1 | | 1/2014 |

OTHER PUBLICATIONS

Office Action and Search Report, Taiwan Application No. 110306835, dated Jun. 14, 2022.
Office Action and Search Report, Taiwan Application No. 110306836, dated Jun. 14, 2022.
Office Action and Search Report, Taiwan Application No. 110306837, dated Jun. 14, 2022.
Office Action and Search Report, Taiwan Application No. 110306838, dated Jun. 14, 2022.
Office Action and Search Report, Taiwan Application No. 110306839, dated Jul. 28, 2022.
Office Action and Search Report, Taiwan Application No. 110306840, dated Jun. 14, 2022.
International Application No. PCT/US2022/033163, International Search Report and Written Opinion, dated Oct. 13, 2022.

* cited by examiner

MODULAR PALETTE

CROSS REFERENCE TO RELATED APPLICATIONS

This application is a divisional of U.S. application Ser. No. 17/349,387, filed on Jun. 16, 2021, the entirety of which is herein expressly incorporated by reference.

FIELD OF THE DISCLOSURE

The present disclosure generally relates to cosmetic products and, more particularly, to cosmetic products having modular features.

BACKGROUND

Containers and storage receptacles for cosmetic products and/or substances are provided in a number of different arrangements and configurations. For example, palettes may be used to retain any number of various eye shadow products having different hues. These palettes may be provided in different sizes to accommodate a desired number of eye shadow products disposed in pans. When used in a professional environment by makeup artists, such larger palettes may be inconvenient to hold and use due to a lack of ergonomic features. Further, it may be cumbersome to use existing palettes due to difficulty in replacing the cosmetic product pans, and/or a lack of stability of the pans. Further, makeup artists may prefer that the container include specific features or components (such as, for example, a see-through lid portion) that differ from what consumers prefer, and as such, manufacturers may have to produce two separate product lines for professional and consumer use.

Accordingly, there is a need for improved accessories having improved functionalities.

SUMMARY

Examples within the scope of the present disclosure are directed to the use of a modular palette having ergonomic and replaceable features. A modular cosmetic product may include a container defining a cavity, an insert, a bezel, and a cosmetic product pan. The insert is adapted to be disposed within the cavity of the container and is at least partially constructed from a magnetic material. The bezel is also adapted to be at least partially disposed within the cavity of the container, and includes at least one opening. The cosmetic product pan is adapted to retain a cosmetic product and is at least partially disposed within the at least one opening of the bezel. The cosmetic product pan is at least partially constructed from a magnetic material such that it is urged towards the insert.

In some examples, the modular cosmetic product may include a cover hingedly coupled with the container. The cover may be at least partially constructed from a magnetic material that urges the cover towards a closed configuration. Further, in some examples, the cover may include an insert coupling mechanism that to removably receives at least one of a first cover insert having a first visual characteristic or a second cover insert having a second visual characteristic.

In some examples, the bezel may be at least partially constructed from a magnetic material. Further, in some forms, the at least one opening of the bezel may frictionally and/or magnetically engage the cosmetic product pan.

In some approaches, the container may be dimensioned to receive a plurality of cosmetic product pans. Further, the bezel may include a plurality of openings adapted to receive a plurality of cosmetic product pans. In some examples, the bezel may include a removal portion that is engageable by a user to remove the bezel from the container. The removal portion may include a tapered ledge. Upon a user engaging the tapered ledge, a portion of the bezel raises to a position above the container.

In some examples, the container may include a pan removal mechanism that is engageable by a user to remove the pan from the container.

In accordance with a second aspect, a modular cosmetic product is provided that includes an insert, a container, and a cosmetic product pan. The insert is at least partially constructed from a magnetic material. The container defines a cavity to receive the insert. Further, the cavity removably couples with at least one of: 1) a first bezel having a first opening configuration; or 2) a second bezel having a second opening configuration. The cosmetic product pan is adapted to retain a cosmetic product and is at least partially disposed within at least one of the first bezel or the second bezel. The cosmetic product pan is at least partially constructed from a magnetic material such that the cosmetic product pan is urged towards the insert.

In accordance with a third aspect, a modular cosmetic product is provided that includes a container defining a cavity, a bezel adapted to be at least partially disposed within the container cavity, and a cosmetic product pan adapted to retain a cosmetic product. The container is at least partially constructed from a magnetic material. The bezel is at least partially constructed from a magnetic material and includes at least one opening. The cosmetic product pan is at least partially disposed within the at least one opening of the bezel and is at least partially constructed from a magnetic material such that the cosmetic product pan is urged towards the container or the bezel.

BRIEF DESCRIPTION OF THE DRAWINGS

The above needs are at least partially met through provision of one, more than one, or any combination of the modular palettes described in the following detailed description, particularly when studied in conjunction with the drawings, wherein.

Figure 1:
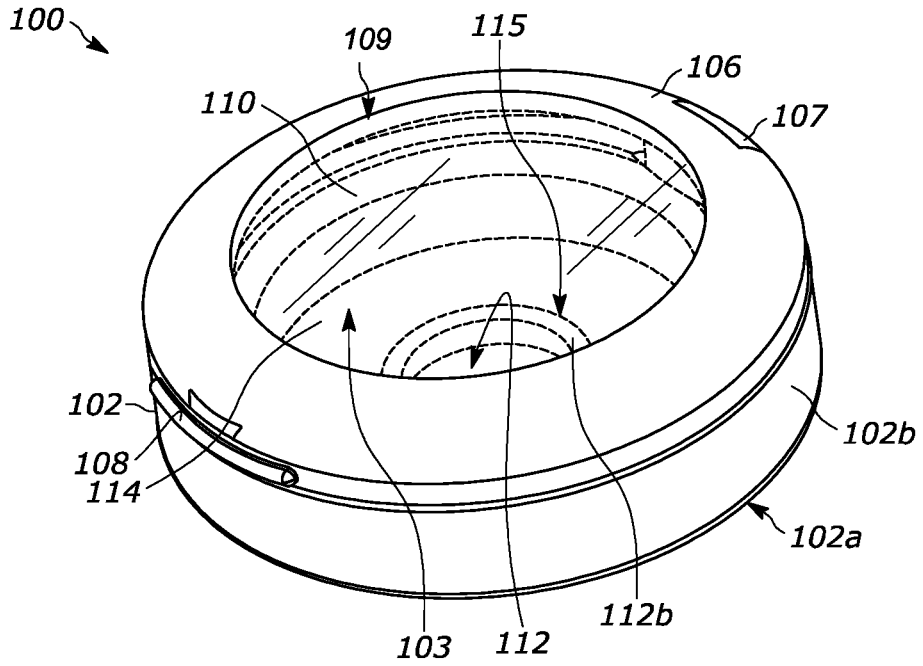
FIG. 1 illustrates a perspective view of a first example modular palette adapted to accommodate a single cosmetic substance pan in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a modular palette is provided having ergonomic and modular, removable features. The modular palettes described herein allow for users to quickly replace or interchange different cosmetic products as desired to create a customized palette containing different product hues, sizes, and/or any other features. Further, the modular palette described herein may securely retain a desired number of cosmetic product pans to ensure the product is not damaged in use. Additionally, the modular palettes described herein may advantageously be used in both professional and consumer environments due in part to a replaceable lid component to allow for interchangeability between a window feature and a mirror feature.

Turning to the Figures, as illustrated in FIGS. 1-7, a first modular cosmetic product 100 is provided in the form of a modular palette. Generally, the modular palette 100 includes a container 102, a cover 106, an insert 114, and a cosmetic product pan 120. The container 102 includes a base 102*a* and a sidewall 102*b* that cooperate to define a cavity 103. The container 102 may be constructed from any number of suitable materials and/or combinations of materials such as, for example, metals, polymers, and the like. As illustrated in FIGS. 1-7, the container 102 has a generally cylindrical body, but as will be discussed with respect to the remaining Figures, other examples of suitable shapes and/or configurations are possible. The base 102*a* and the sidewalls 102*b* may have a generally curved or chamfered transition to enhance comfort when handled by a user.

As will be discussed in further detail below, in some examples, the base 102*a* of the container defines a pan removal mechanism 112 in the form of an opening or throughbore. Further, in some examples, the sidewall 102*b* includes a container hinge region 104 in the form of an opening to cooperate with the cover 106.

Figure 2:
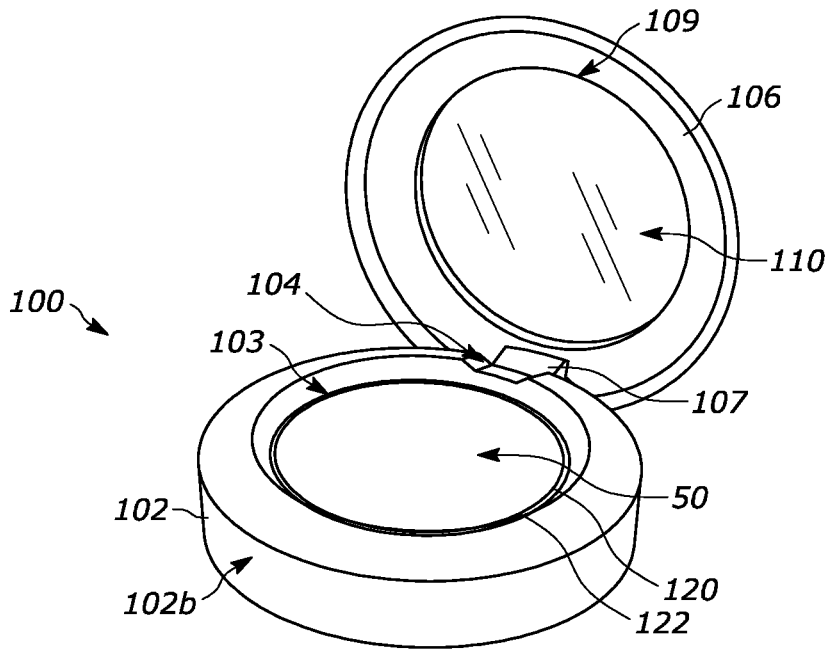
FIG. 2 illustrates a perspective view of the example modular palette of FIG. 1 in an opened configuration in accordance with various embodiments.
Figure 3:
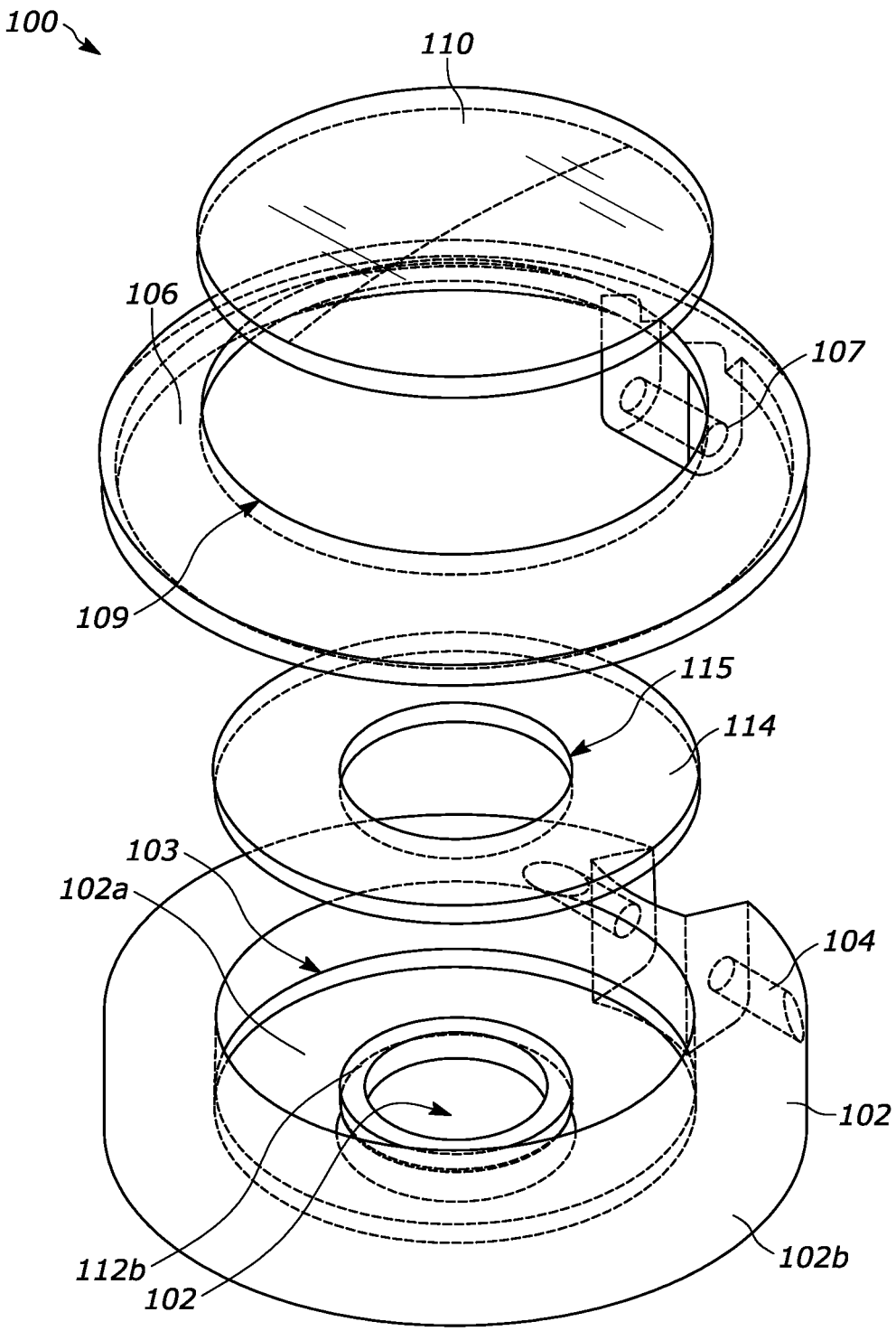
FIG. 3 illustrates an exploded perspective view of the example modular palette of FIGS. 1 and 2 in accordance with various embodiments.
Figure 4:
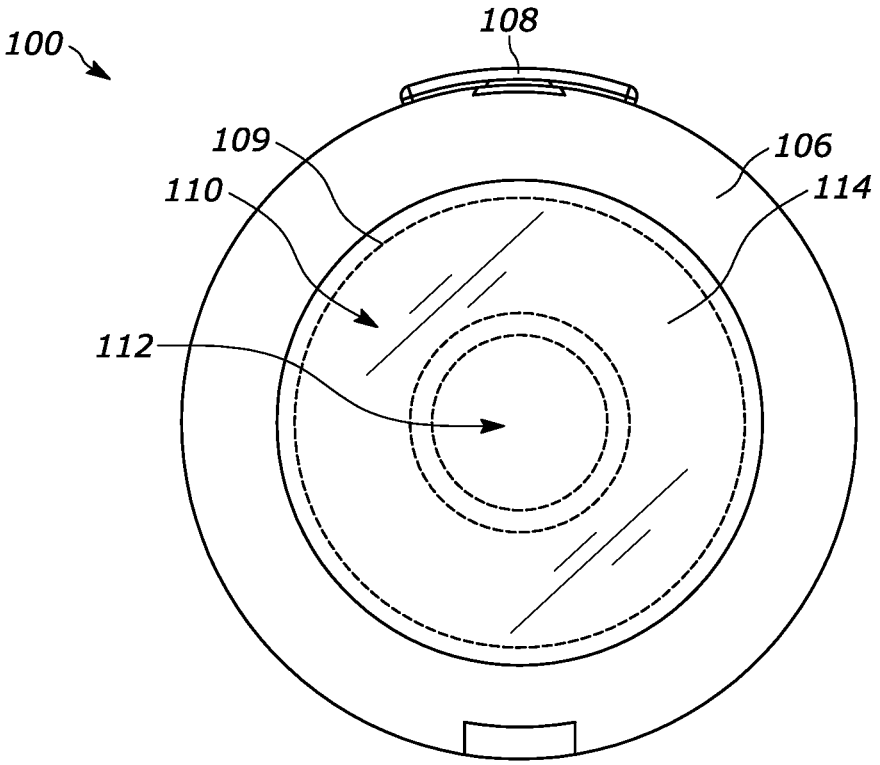
FIG. 4 illustrates a top plan view of the example modular palette of FIGS. 1-3 in accordance with various embodiments.
Figure 5:
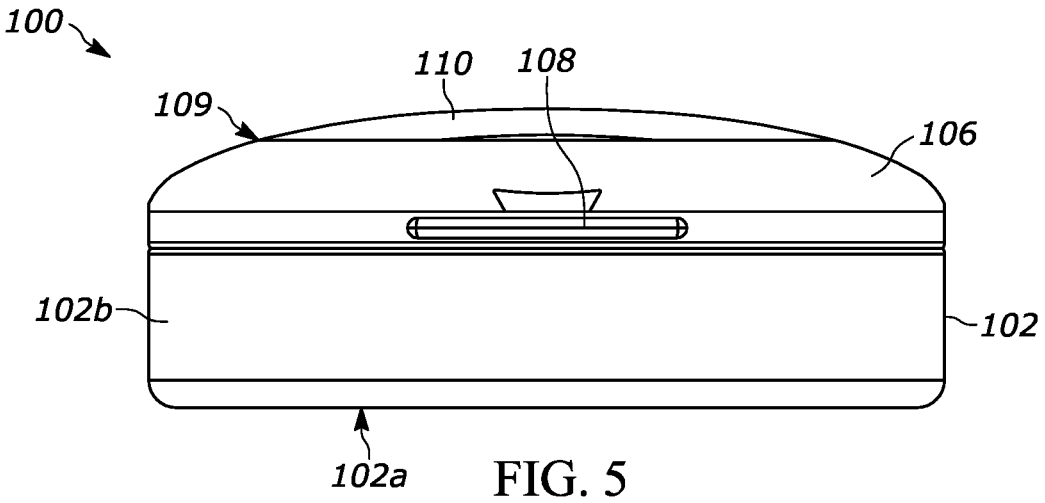
FIG. 5 illustrates a front elevation view of the example modular palette of FIGS. 1-4 in accordance with various embodiments.
Figure 6:
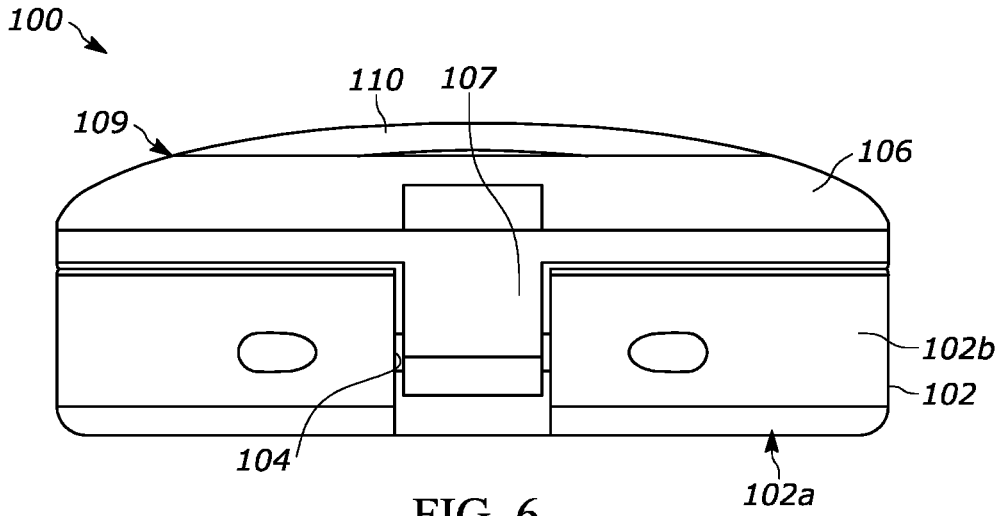
FIG. 6 illustrates a rear elevation view of the example modular palette of FIGS. 1-5 in accordance with various embodiments.

The cover 106 may be in the form of a lid or a cap and includes a cover hinge 107 that engages with the container hinge region 104 to hingedly couple the cover 106 with the container 102. In the illustrated example, the cover hinge 107 is in the form of an extension 107*a* that extends downwardly from the cover 106 which includes any number of protrusions 108*b* that engage the corresponding container hinge region 104. In other examples, however, the components of the container hinge region 104 and the cover hinge 107 may be reversed. This engagement between the container 102 and the cover 106 allow the cover 106 to swivel between a closed configuration (as illustrated in FIGS. 1 and 4-7) and an open configuration (as illustrated in FIG. 2). In some examples, the cover 106 may additionally include an engaging member 108 in the form of a protrusion that a user may grasp to assist with moving the cover 106. In some examples, the sidewall 102*b* may include a depression or an opening (not illustrated) to provide additional clearance to allow a user to properly grasp the engaging member 108.

When in the closed configuration, the cover 106 may be secured with the container 102 via any number of suitable approaches such as, for example, a frictional engagement between the cover 106 and the sidewall 102*b*, a magnetic attraction between these components, a locking/release mechanism, and the like. Other examples may be used.

The cover 106 additionally includes a cover insert coupling mechanism 109 in form of an opening. In some examples, the cover insert coupling mechanism 109 may have a tapered or conical profile, and in other examples, the cover insert coupling mechanism 109 may have a constant or fixed diameter. The cover insert coupling mechanism 109 receives any number of varying cover inserts 110 in the form of disks. For example, a first cover insert 110 may have a first visual characteristic, and a second cover insert 110 may have a second, different visual characteristic. More specifically, the first cover insert 110 may have a first visual characteristic in the form of a transparent and/or translucent body to allow a user (e.g., a makeup artist) to visually identify the contents within the cavity 103 when the cover 106 is closed. Further, the second cover insert 110 may have a second visual characteristic in the form of a reflective or mirrored body to assist a user (e.g., a consumer) with visualizing their face when applying the cosmetic product. In other examples, the cover insert 110 may have a selectively transparent, translucent, and/or reflective body. For example, a one-way mirror may be used. Other examples are possible.

The cover insert 110 is insertable into the insert coupling mechanism 109. In examples where the insert coupling mechanism 109 has a generally tapered profile, the cover insert 110 may have a corresponding tapered outer profile that frictionally engages the tapered profile of the insert coupling mechanism 109. Such a tapered profile may prevent the cover insert 110 from being urged through a lower side of the cover 106. In other examples, the insert coupling mechanism 109 may include a lower ledge and/or protrusion to prevent the cover insert 110 from being urged through the lower side of the cover 106. In any event, the cover insert 110 may be removed or otherwise decoupled from the insert coupling mechanism 109 by pushing the cover insert 110 in an opposite direction.

Figure 7:
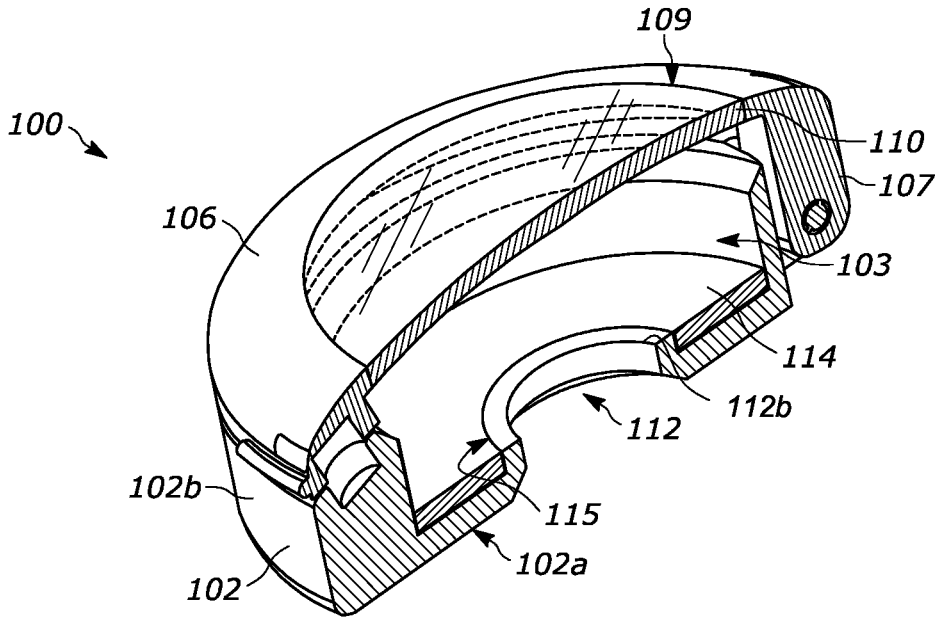
FIG. 7 illustrates a perspective cross-sectional view of the example modular palette of FIGS. 1-6 in accordance with various embodiments.
Figure 8:
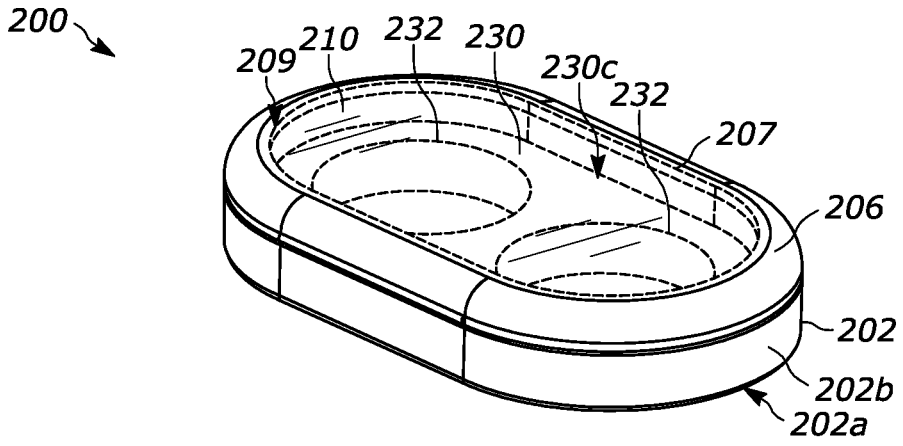
FIG. 8 illustrates a perspective view of a second example modular palette adapted to accommodate two cosmetic substance pans in accordance with various embodiments.

The insert 114 is in the form of a flat disc that may be disposed on or near the base 102*a* of the container 102. Notably, the insert 114 may be constructed from a magnetic material. In some examples, the insert 114 includes an opening or throughbore 115 that is axially aligned with the pan removal mechanism 112. In this example, and as illustrated in FIG. 7, the pan removal mechanism 112 may define a ledge 112*b* that engages the opening 115 of the insert 114. The insert 114 may be retained within the cavity 103 by any number of suitable approaches. For example, the insert 114 may frictionally engage the sidewall 102*b* (and/or the ledge of the pan removal mechanism 112), may be adhered with the container 102 using adhesives and/or ultrasonic welding, and/or may be magnetically coupled with the container 102. Other examples are possible. In these examples, the insert 114 acts as the floor or bottom surface of the cavity 103 when disposed therein.

The cosmetic product pan 120 (FIG. 2) includes a base and a sidewall that define a volume 121 to retain a cosmetic product or substance 50. For example, the cosmetic product pan 120 may retain an eyeshadow product, other compressed powdered products such as, for example, highlighter products, contour products, and/or concealer products, and hot pour items such as, for example, lip products, eye products, concealer products, and/or brow products and the like. Other examples are possible. In the example illustrated in FIGS. 1-7, the cosmetic product pan 120 is at least partially disposed within the cavity 103 such that it is positioned adjacent to the sidewall 102*b* and the insert 114.

The cosmetic product pan 120 is at least partially constructed from a magnetic material (e.g., tin). More specifically, all or a portion of the cosmetic product pan 120 may be magnetic such that it is attracted to and magnetically coupled with the insert 114, and as such, is retained within the cavity 103 when disposed therein. In some examples, the cosmetic product pan 120 may be constructed from a non-magnetic material, and a separate magnet may be operably coupled therewith to cause the cosmetic product pan 120 to be magnetically coupled with the insert 114.

As illustrated in FIG. 7, an upper end of the sidewall 102*b* may include a chamfered region. The cosmetic product pan 120 may include a lip 122 that rests on or near this chamfered region of the sidewall 102*b*. In some examples, a gap may be formed between the chamfered region of the sidewall 102*b* and the lip 122 to allow a user to grasp the lip 122 to remove the cosmetic product pan 120 from the cavity 103. In some examples, in addition to the magnetic coupling between the insert 114 and the cosmetic product pan 120, the sidewall 102*b* may be dimensioned such that the cosmetic product pan 120 frictionally engages the sidewall 102*b* to assist with retaining the cosmetic product pan 120 within the cavity 103.

The cosmetic product pan 120 may be removed from the cavity 103 by inserting a member (e.g., a user's finger) through the pan removal mechanism 112 and pushing upwardly against the base of the cosmetic product pan 120 until overcoming the gravitational force (and, in some examples, the frictional force) between the insert 114 and the cosmetic product pan 120. Upon removing the cosmetic product pan 120 from the cavity 103, a different cosmetic product pan (e.g., a replacement pan including a refill, a cosmetic product 50 having a different color/hue, and/or a different type of cosmetic product 50) may be coupled with the container 102. Accordingly, a user may use a single container 102 for varying uses as desired.

As illustrated in FIGS. 8-11, an alternative modular palette 200 (illustrated without a cosmetic product pan) is provided. It will be appreciated that the modular palette 200 illustrated in FIGS. 8-11 may include similar features to the modular palette 100, and thereby elements illustrated in FIGS. 8-11 are designated by similar reference numbers indicated on the example illustrated in FIGS. 1-7, increased by 100. Accordingly, these features will not be described in substantial detail. Further, it is appreciated that any combination or sub-combination of features described in regard to the modular palette 200 may be incorporated into the modular palette 100, and vice-versa.

The modular palette 200 includes a container 202, a cover 206, a cover insert 210, and a bezel 230. In some approaches, a magnetic insert (not illustrated) in the form of a flat disk may be provided that is insertable into the cavity 203 of the container 202.

In this example, the container 202 has a larger overall size than the container 102 described with respect to FIGS. 1-7. In this example, the container 202 has an ovoid shape that includes an elongated sidewall 203*b*.

Like the above-described insert 114, the bezel 230 is adapted to be at least partially disposed within the cavity 203 of the container 202. Notably, the bezel 230 may be partially or entirely constructed from a magnetic material. Further, in some examples, the bezel 230 may include a number of magnets positioned at or near a periphery thereof. The bezel 230 has a similar shape as the cavity 203, and in some examples, may frictionally engage the sidewall 202*b* of the container 202. The bezel 230 may be retained within the cavity 203 by this frictional engagement and/or by a magnetic coupling between the bezel 230 and the container 202.

The bezel 230 includes any number of openings 232. In the illustrated example, the bezel 230 includes two openings 232, but other examples are possible. Each opening 230 is adapted to receive a cosmetic product pan (not illustrated) therein. In some examples, the cosmetic product pan, which may be constructed from a magnetic material, may magnetically couple with the bezel 230, which itself may be magnetically or otherwise retained within the container 202. In other examples, the cosmetic product pan may alternatively or additionally frictionally engage a sidewall of the opening (and/or may rest on an upper periphery thereof) to be retained therewith. In yet other examples, the cosmetic product pan may alternatively or additionally be magnetically coupled with a separate insert disposed below the bezel 230. In still other examples, the cosmetic product pan may alternatively or additionally be magnetically coupled with the base 202*a* of the container 202. In any event, the cosmetic product pan is magnetically retained within the container 202 while being selectively removable therefrom.

Figure 9:
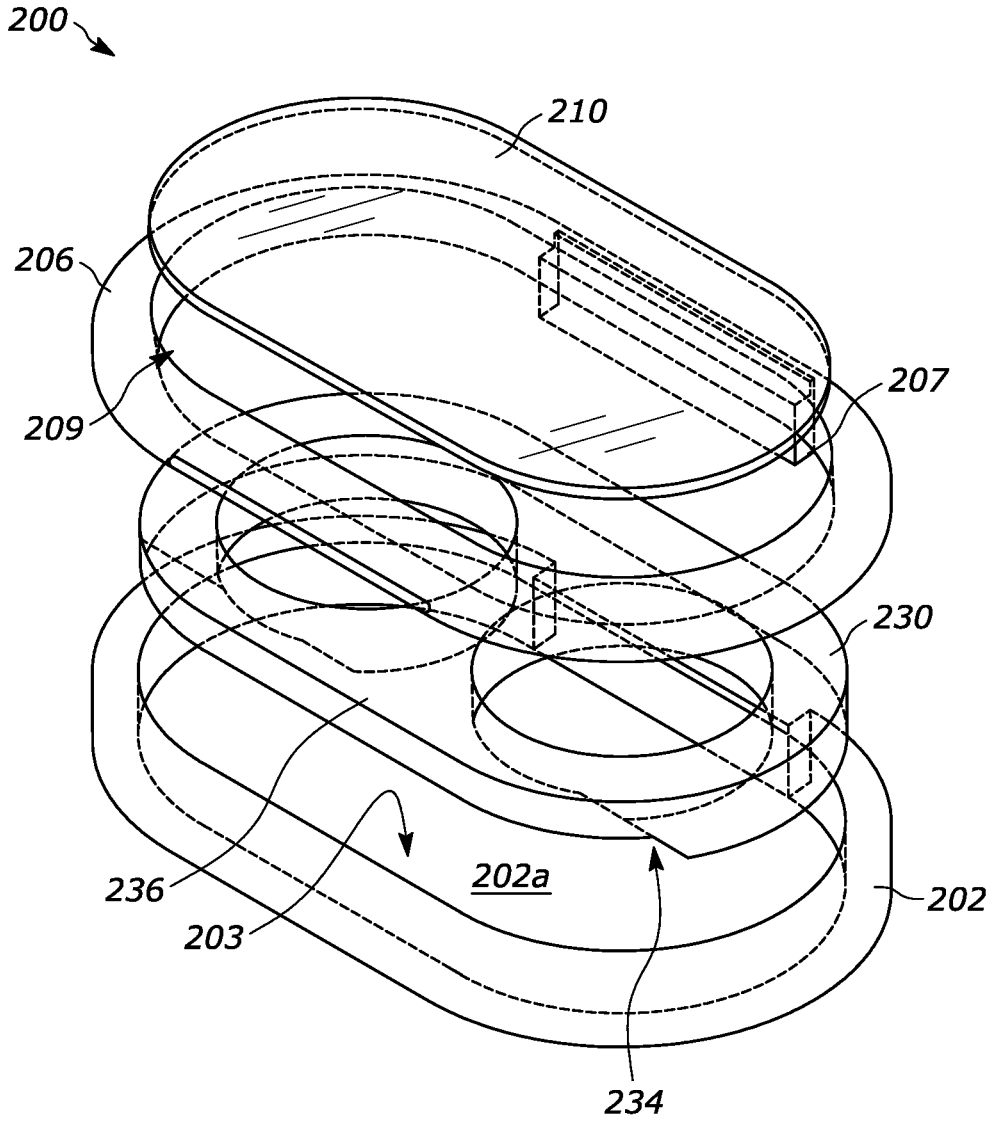
FIG. 9 illustrates an exploded perspective view of the example modular palette of FIG. 8 in accordance with various embodiments.
Figure 10:
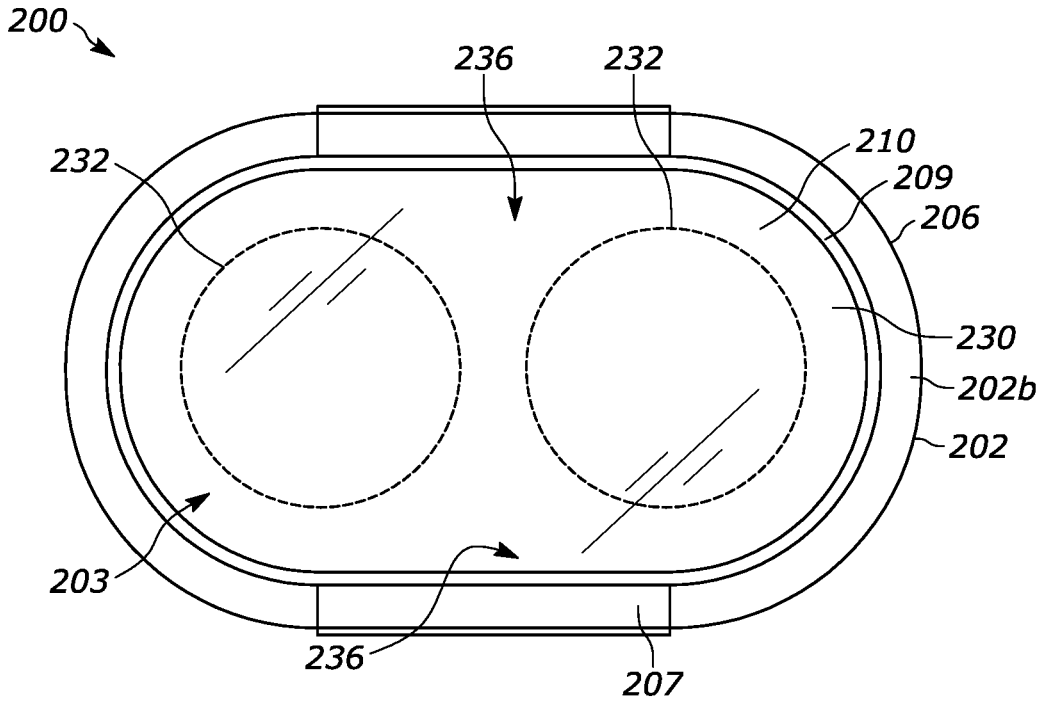
FIG. 10 illustrates a top plan view of the example modular palette of FIGS. 8 and 9 in accordance with various embodiments.
Figure 11:
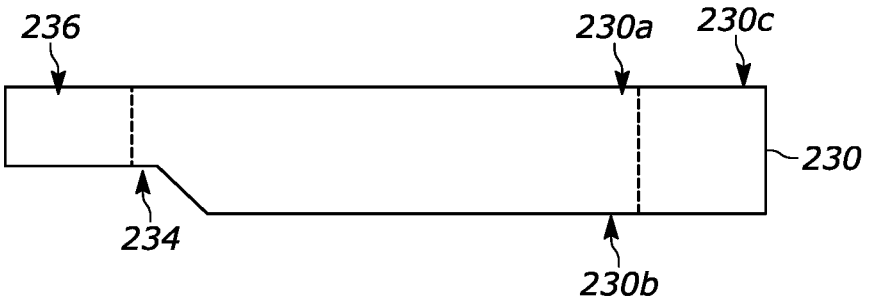
FIG. 11 illustrates a side elevation view of an example bezel for use with the example modular palette of FIGS. 8-10 in accordance with various embodiments.

With reference to FIGS. 9 and 11, the bezel 230 may additionally include a removal portion 234 in the form of a taper, a ramp, or a ledge extending between an upper surface 230*a* and a lower surface 230*b* thereof. The removal portion 234 further includes an engaging region 236. When the bezel 230 is disposed within the cavity 203, a user may engage the engaging region 236 by pressing downwardly (i.e., into the cavity 203). Such urging is sufficient to overcome any magnetic and frictional forces, and will cause a rear portion 230*c* of the bezel 230 to lift up and out of the cavity 203. A user may then grasp the rear portion 230*c* of the bezel 230 and remove it from the cavity 203. In some examples, removing the bezel 230 from the cavity 203 will cause any cosmetic product pans to also be removed from the cavity 203. In these examples, a user may decouple the cosmetic product pan or pans from the opening 232 by placing a member (e.g., their finger) on an underside of the opening 232 and pushing upwardly. In other examples (e.g., when a separate magnetic insert is used and disposed within the cavity 203 in addition to the bezel 230), removing the bezel 230 from the cavity 203 will cause the cosmetic product pans to be retained within the cavity 203. A user may then grasp the cosmetic product pans to remove them from the container 202.

Figure 12:
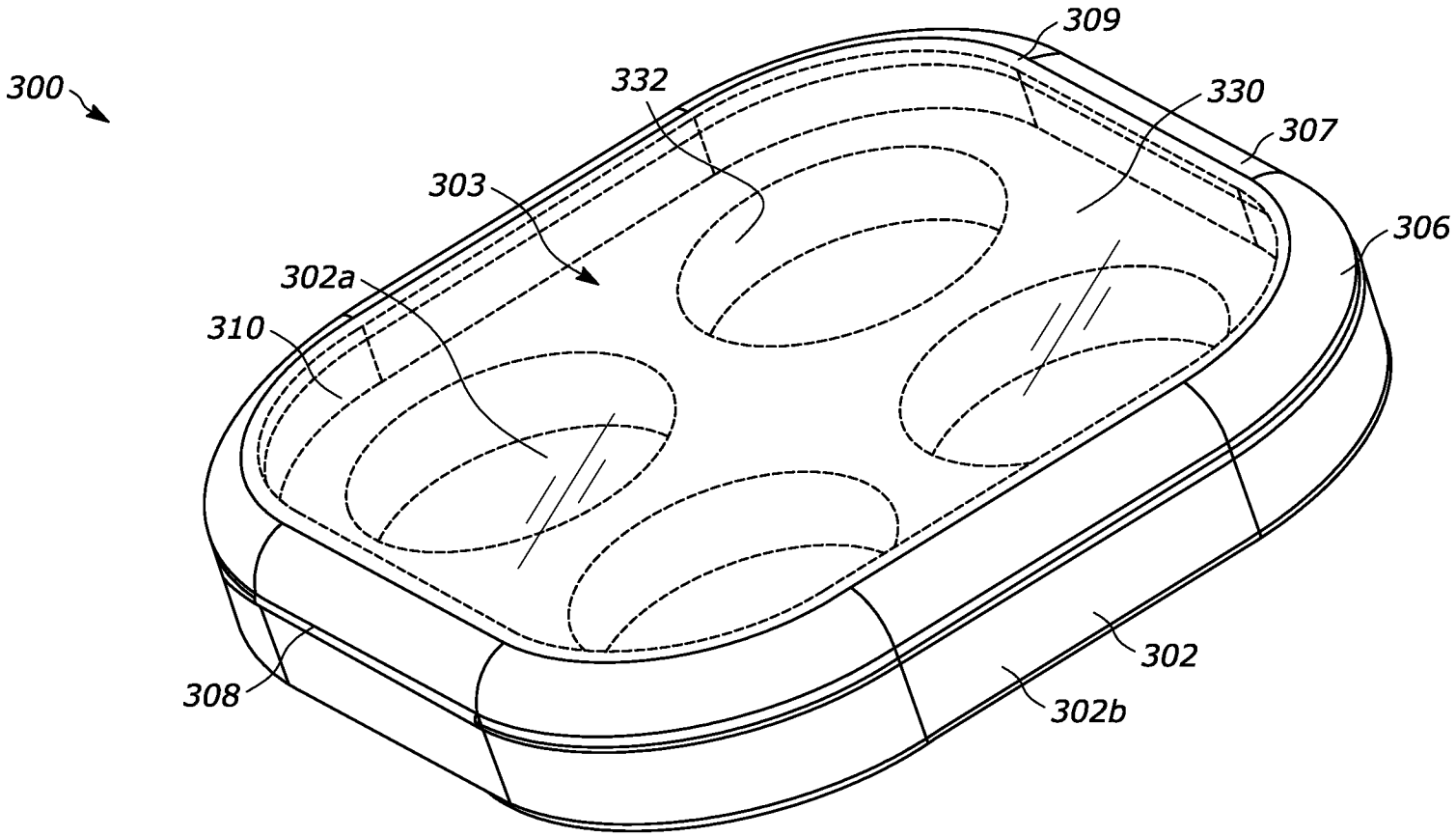
FIG. 12 illustrates a perspective view of a third example modular palette adapted to accommodate four cosmetic substance pans in accordance with various embodiments.
Figure 13:
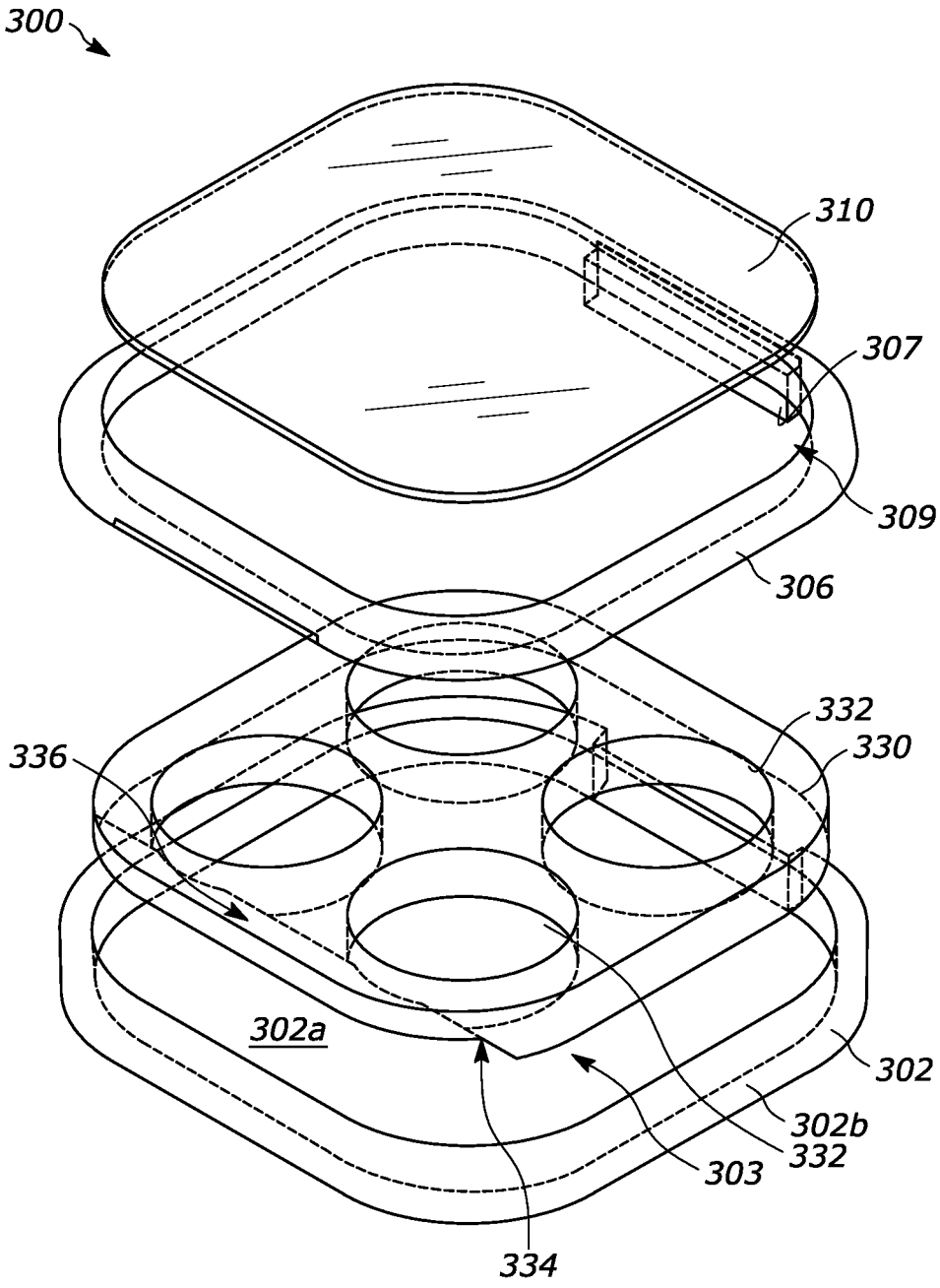
FIG. 13 illustrates an exploded perspective view of the example modular palette of FIG. 12 in accordance with various embodiments.
Figure 14:
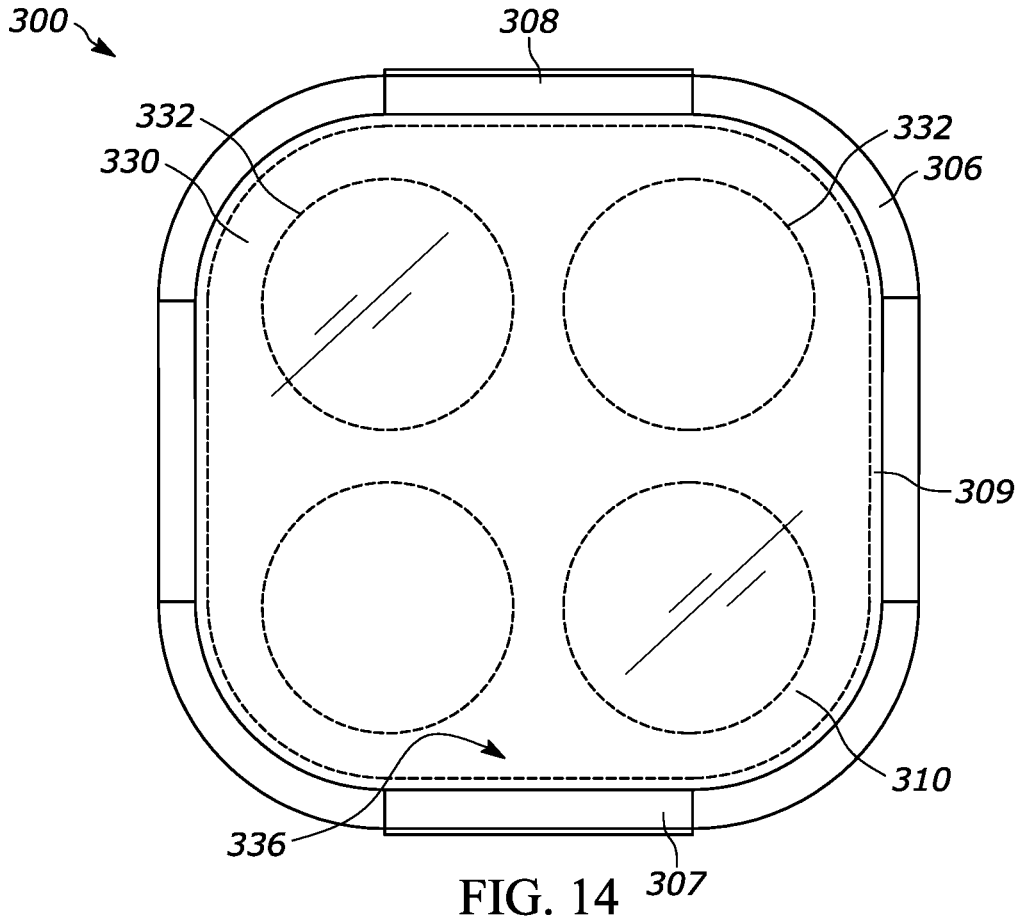
FIG. 14 illustrates a top plan view of the example modular palette of FIGS. 12 and 13 in accordance with various embodiments.

As illustrated in FIGS. 12-14, an alternative modular palette 300 (illustrated without a cosmetic product pan) is provided. It will be appreciated that the modular palette 300 illustrated in FIGS. 12-14 may include similar features to the modular palettes 100, 200, and thereby elements illustrated in FIGS. 12-14 are designated by similar reference numbers indicated on the example illustrated in FIGS. 1-11, increased by 100 or 200, respectively. Accordingly, these features will not be described in substantial detail. Further, it is appreciated that any combination or sub-combination of features described in regard to the modular palette 300 may be incorporated into the modular palettes 100, 200, and vice-versa.

In this example, the container 302 has a larger overall size than the containers 102, 202 described with respect to FIGS. 1-11. In this example, the container 302 has a generally square shape having rounded corners (e.g., a squircle). The container 302 includes a removable bezel 330 having four openings 332 to receive four cosmetic product pans. However, other bezel arrangements are possible.

Figure 15:
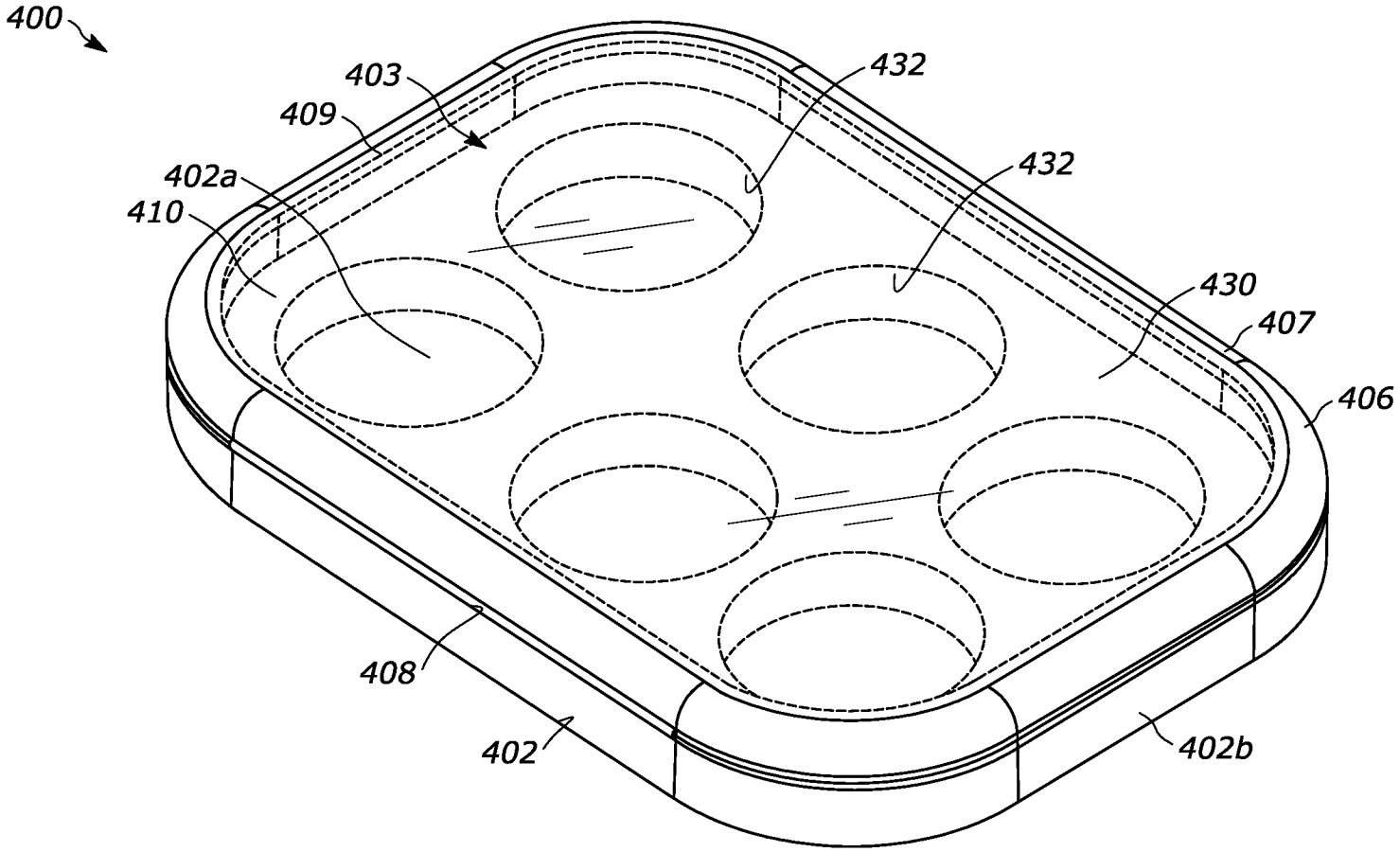
FIG. 15 illustrates a perspective view of a fourth example modular palette adapted to accommodate two cosmetic substance pans in accordance with various embodiments.
Figure 16:
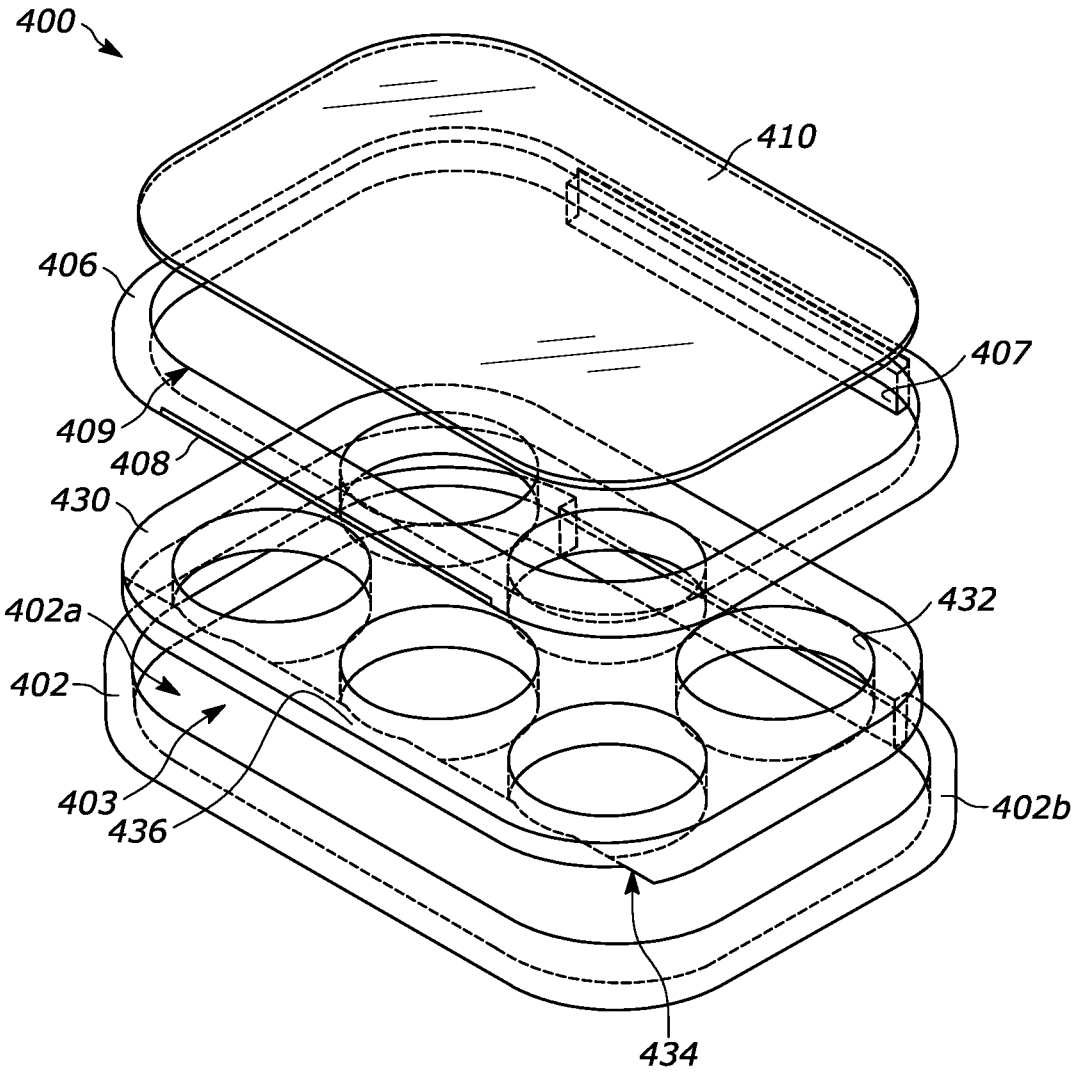
FIG. 16 illustrates an exploded perspective view of the example modular palette of FIG. 15 in accordance with various embodiments.
Figure 17:
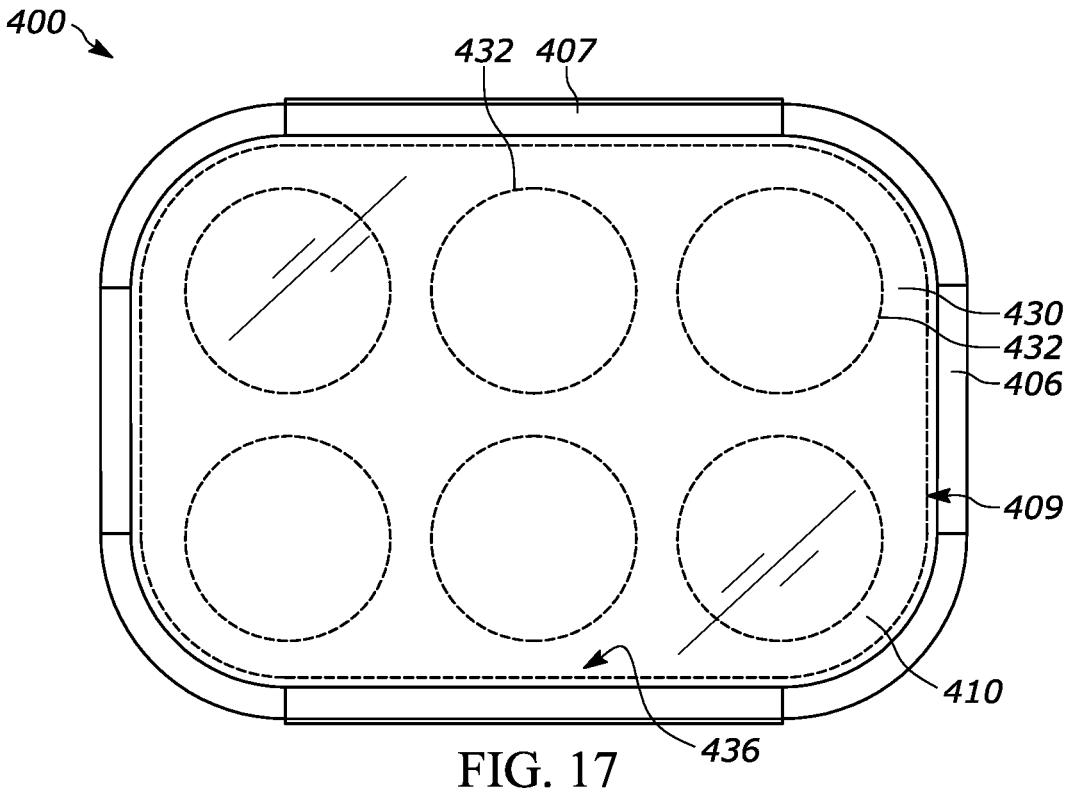
FIG. 17 illustrates a top plan view of the example modular palette of FIGS. 15 and 16 in accordance with various embodiments.

As illustrated in FIGS. 15-17, an alternative modular palette 400 (illustrated without a cosmetic product pan) is provided. It will be appreciated that the modular palette 400 illustrated in FIGS. 15-17 may include similar features to the modular palettes 100, 200, 300, and thereby elements illustrated in FIGS. 15-17 are designated by similar reference numbers indicated on the example illustrated in FIGS. 1-14, increased by 100, 200, or 300, respectively. Accordingly, these features will not be described in substantial detail. Further, it is appreciated that any combination or sub-combination of features described in regard to the modular palette 400 may be incorporated into the modular palettes 100, 200, 300, and vice-versa.

In this example, the container 402 has a larger overall size than the containers 102, 202, 302 described with respect to FIGS. 1-14. In this example, the container 402 has a generally rectangular shape having rounded corners. The container 402 includes a removable bezel 430 having six openings 432 to receive four cosmetic product pans. However, other bezel arrangements are possible.

Figure 18:
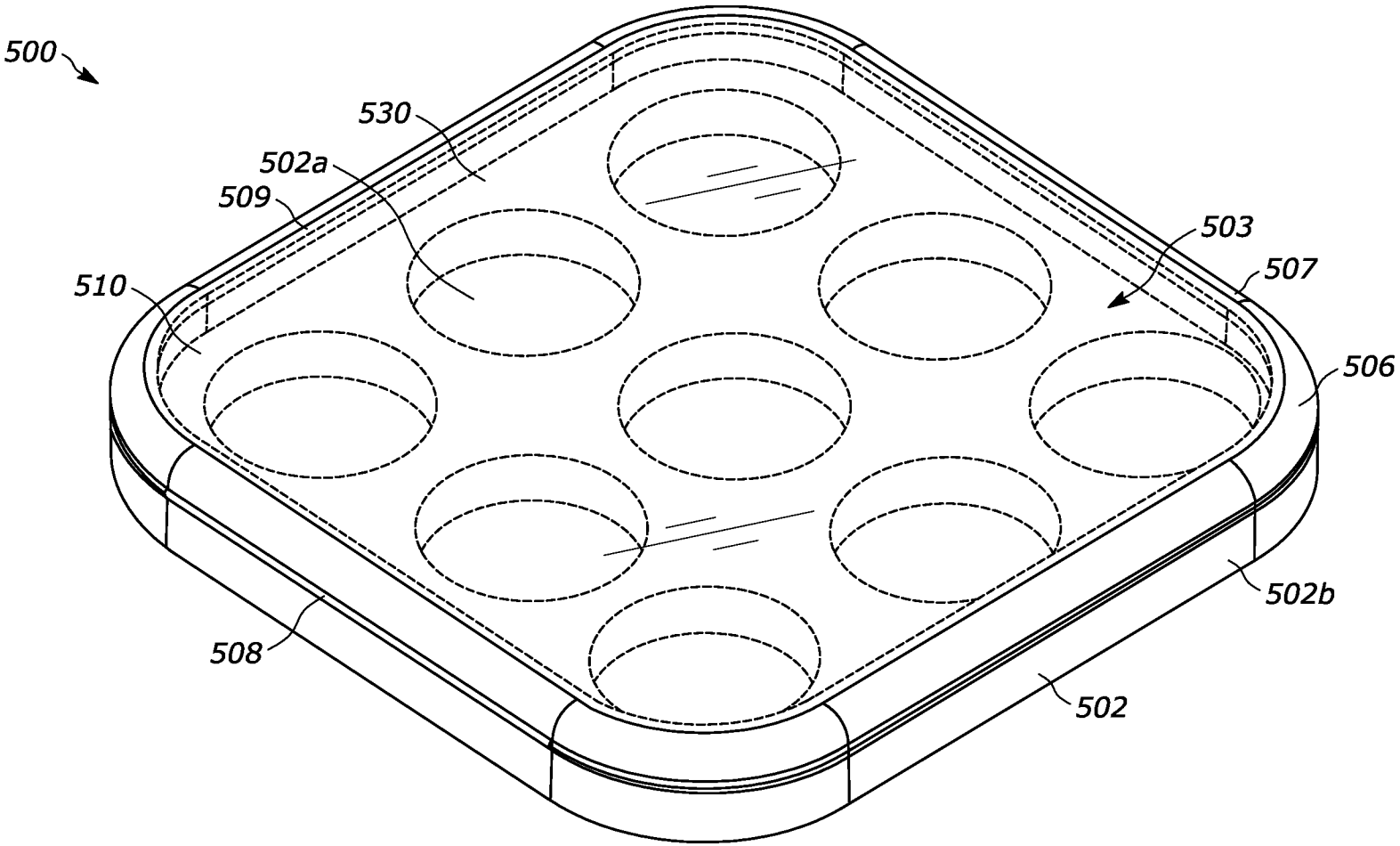
FIG. 18 illustrates a perspective view of a fifth example modular palette adapted to accommodate nine cosmetic substance pans in accordance with various embodiments.
Figure 19:
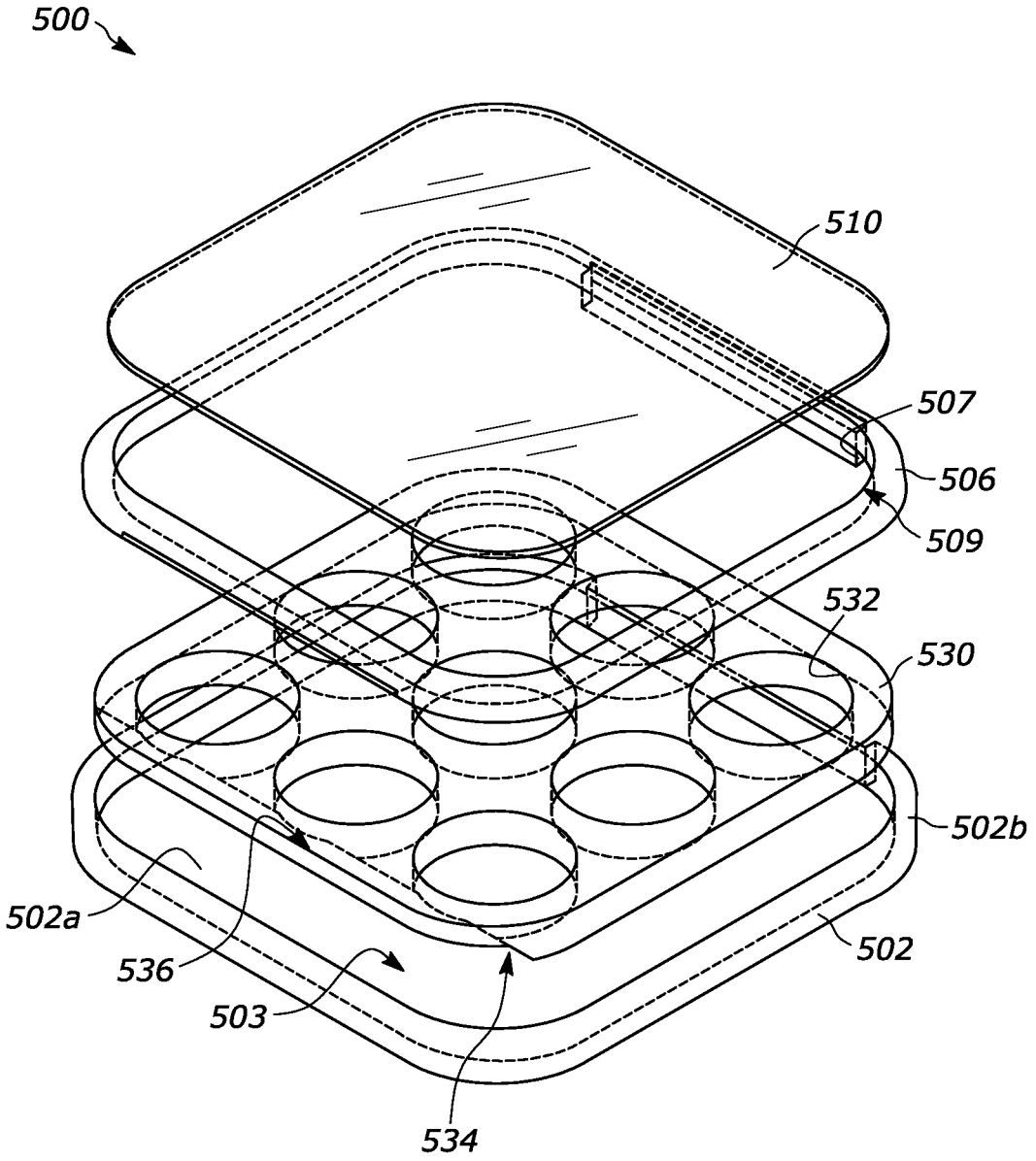
FIG. 19 illustrates an exploded perspective view of the example modular palette of FIG. 18 in accordance with various embodiments.
Figure 20:
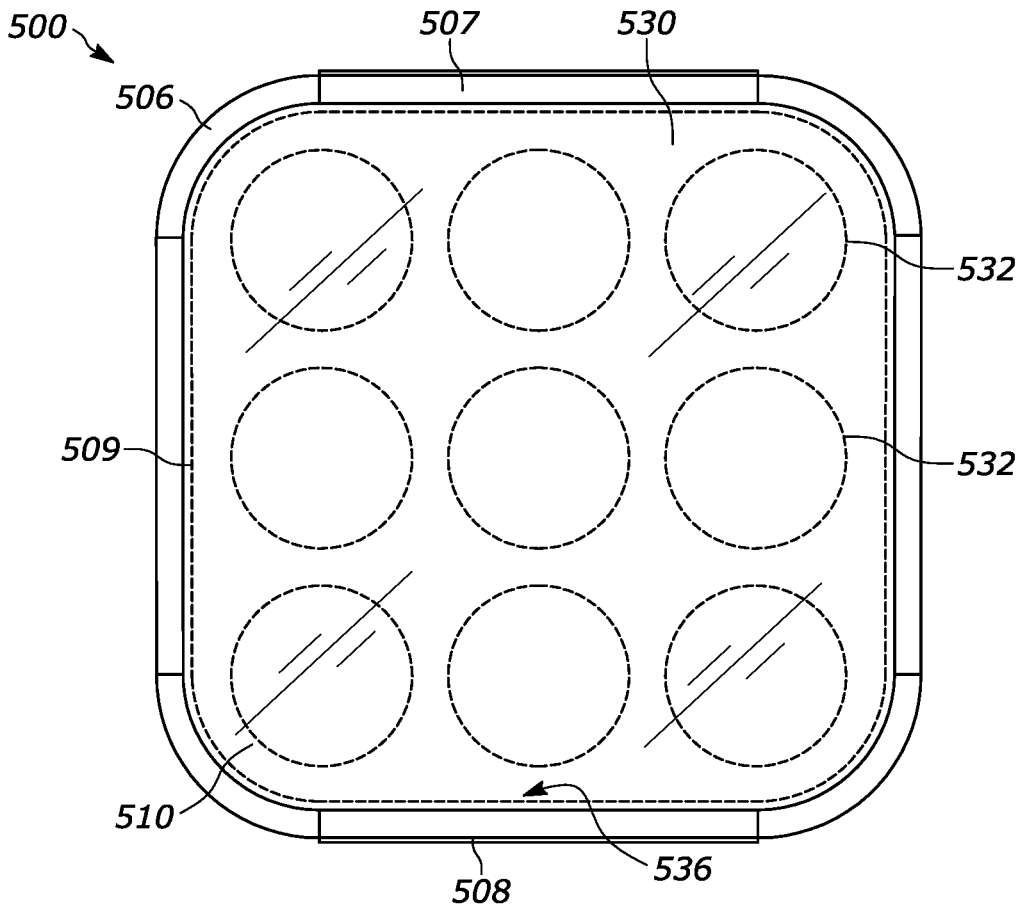
FIG. 20 illustrates a top plan view of the example modular palette of FIGS. 18 and 19 in accordance with various embodiments.

As illustrated in FIGS. 18-20, an alternative modular palette 500 (illustrated without a cosmetic product pan) is provided. It will be appreciated that the modular palette 500 illustrated in FIGS. 18-20 may include similar features to the modular palettes 100, 200, 300, 400, and thereby elements illustrated in FIGS. 18-20 are designated by similar reference numbers indicated on the example illustrated in FIGS. 1-17, increased by 100, 200, 300, or 400, respectively. Accordingly, these features will not be described in substantial detail. Further, it is appreciated that any combination or sub-combination of features described in regard to the modular palette 500 may be incorporated into the modular palettes 100, 200, 300, 400, and vice-versa.

In this example, the container 502 has a larger overall size than the containers 102, 202, 302, 402 described with respect to FIGS. 1-17. In this example, the container 502 has a generally square shape having rounded corners. The container 502 includes a removable bezel 530 having nine openings 532 to receive four cosmetic product pans. However, other bezel arrangements are possible.

Figure 21:
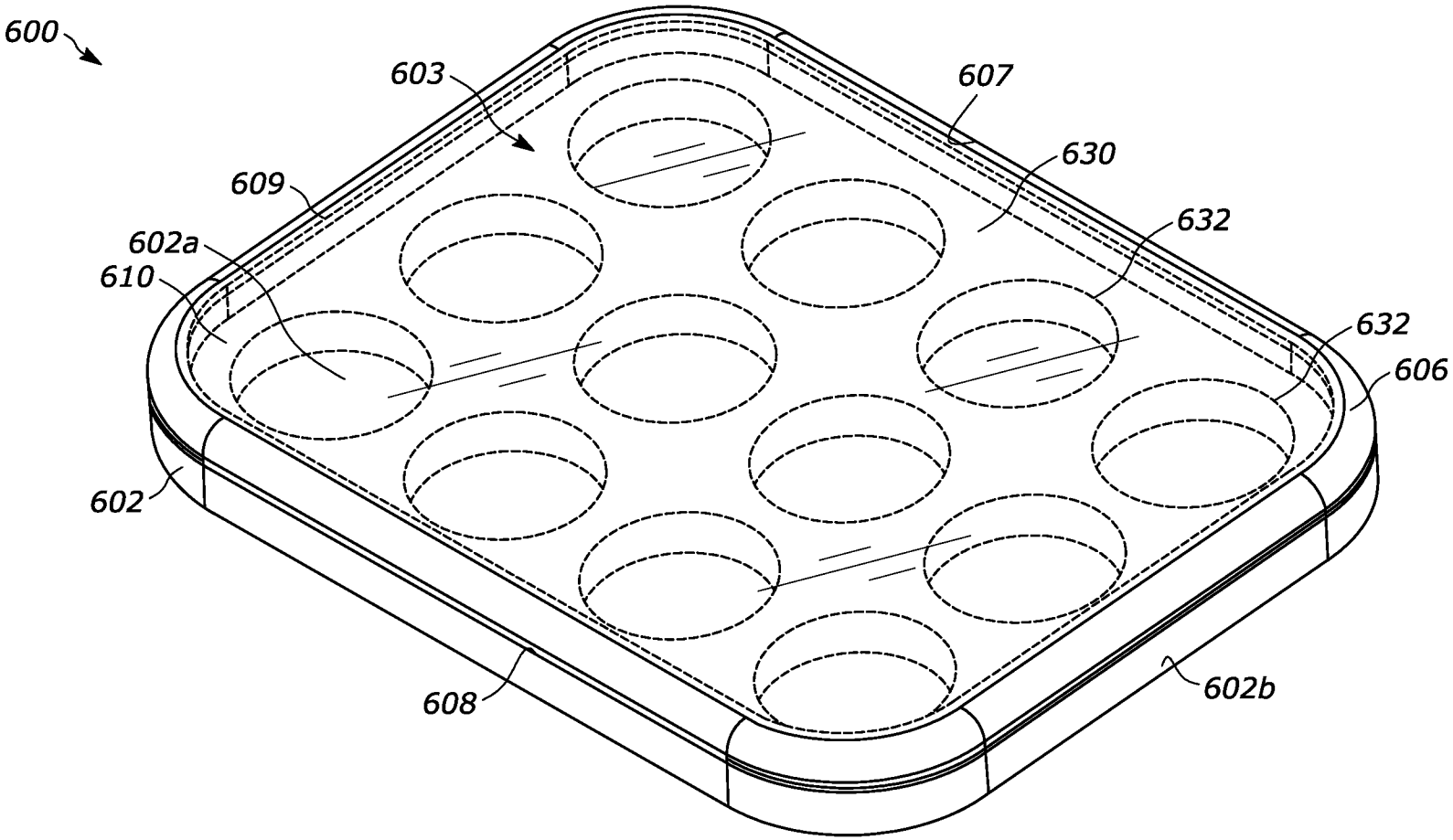
FIG. 21 illustrates a perspective view of a sixth example modular palette adapted to accommodate two cosmetic substance pans in accordance with various embodiments.
Figure 22:
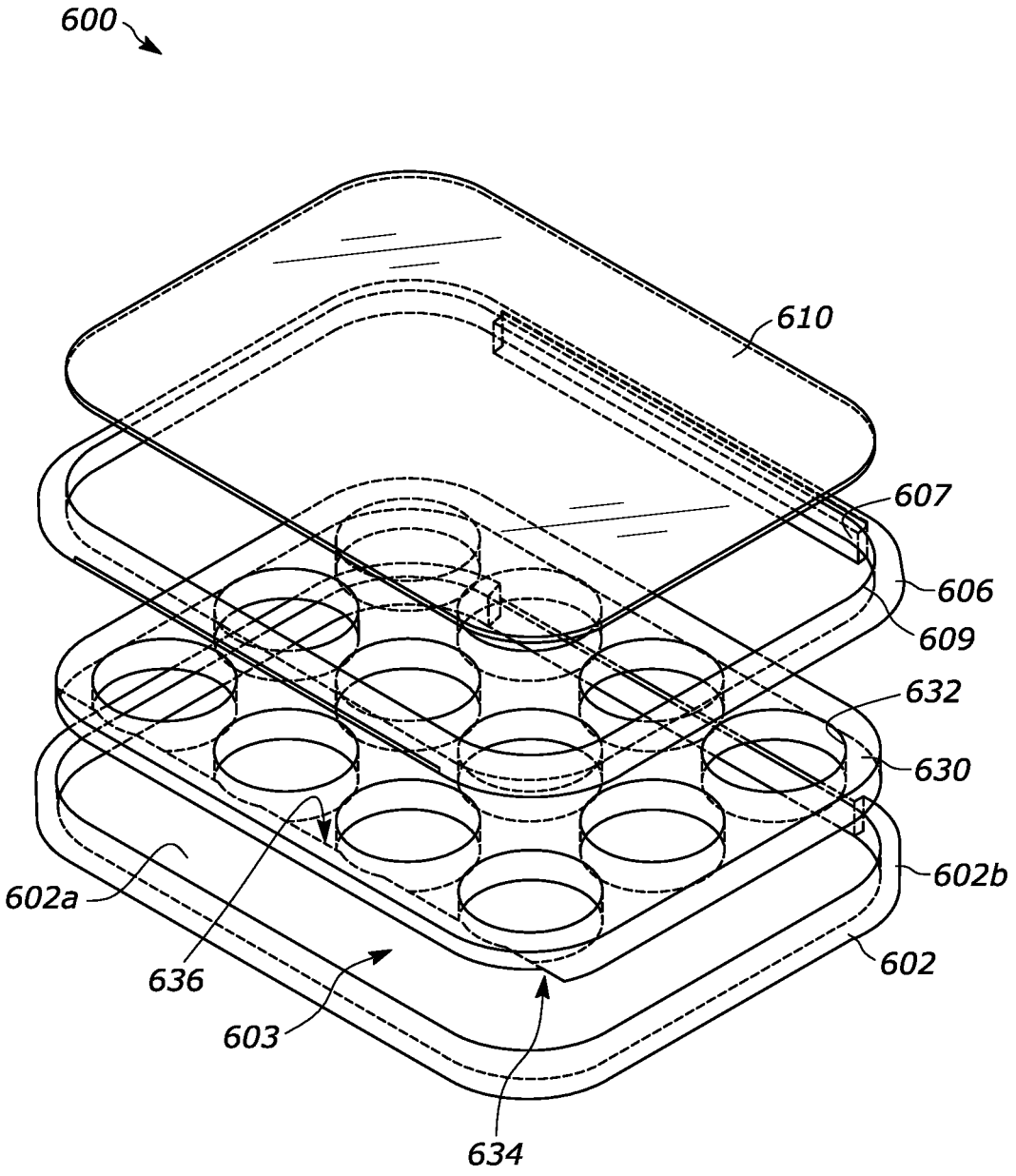
FIG. 22 illustrates an exploded perspective view of the example modular palette of FIG. 21 in accordance with various embodiments.
Figure 23:
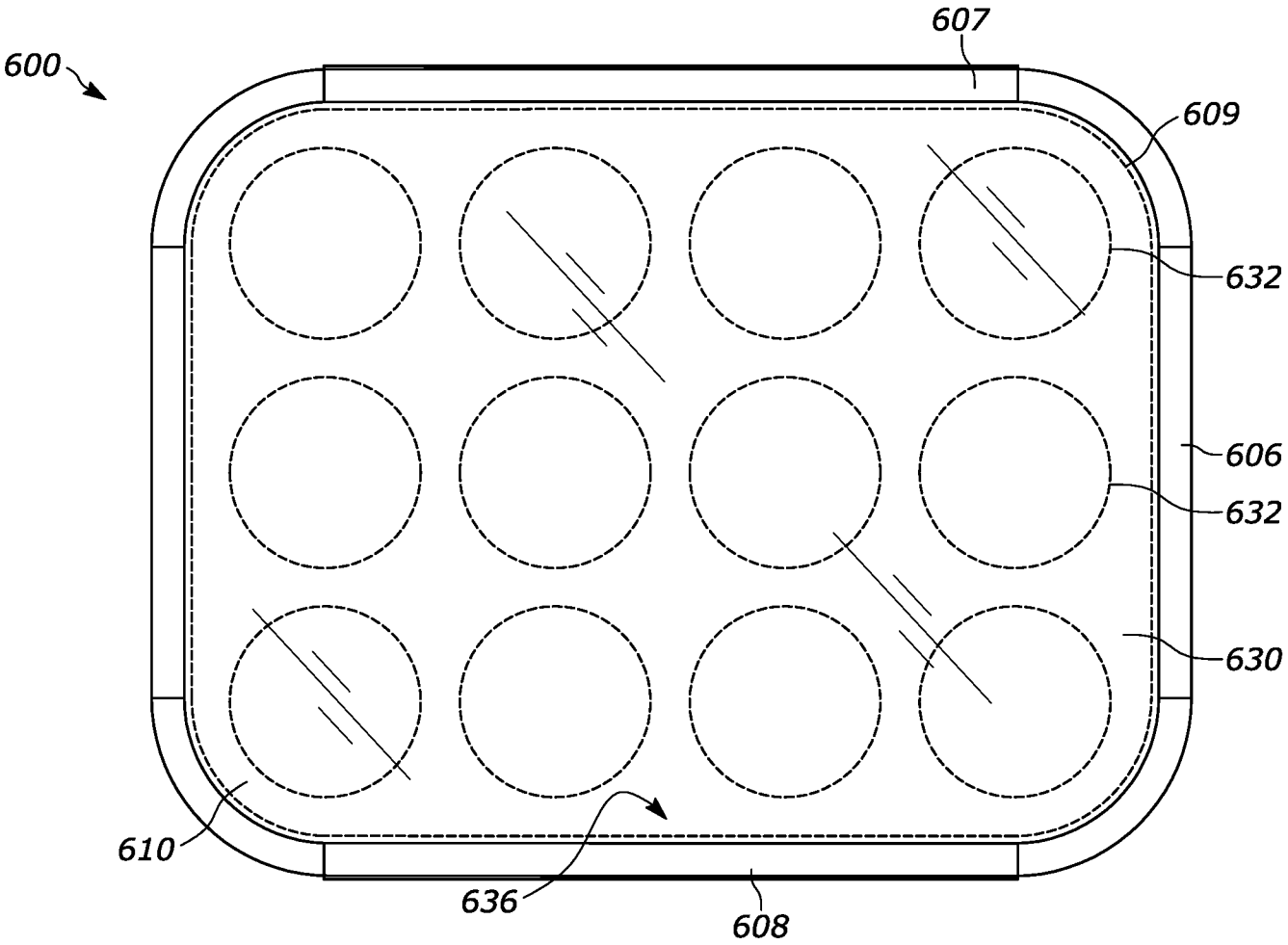
FIG. 23 illustrates a top plan view of the example modular palette of FIGS. 21 and 22 in accordance with various embodiments.

As illustrated in FIGS. 21-23, an alternative modular palette 600 (illustrated without a cosmetic product pan) is provided. It will be appreciated that the modular palette 600 illustrated in FIGS. 21-23 may include similar features to the modular palettes 100, 200, 300, 400, 500, and thereby elements illustrated in FIGS. 21-23 are designated by similar reference numbers indicated on the example illustrated in FIGS. 1-20, increased by 100, 200, 300, 400, or 500, respectively. Accordingly, these features will not be described in substantial detail. Further, it is appreciated that any combination or sub-combination of features described in regard to the modular palette 600 may be incorporated into the modular palettes 100, 200, 300, 400, 500, and vice-versa.

In this example, the container 602 has a larger overall size than the containers 102, 202, 302, 402, 502 described with respect to FIGS. 1-20. In this example, the container 402 has a generally rectangular shape having rounded corners. The container 602 includes a removable bezel 630 having 12 openings 632 to receive four cosmetic product pans. However, other bezel arrangements are possible.

So configured, the modular palettes described herein allow a user to selectively retain any number of desired cosmetic product pans in any number of varying configurations and/or arrangements. The cosmetic product pans may quickly be coupled with and decoupled from the container to allow a user to travel with their desired cosmetic product. The cosmetic product pans are securely retained within the container via magnetic and/or frictional forces, and as such, will not be damaged during use or transport.

In some examples, different bezels may be provided for a specific container 102, 202, 302, 402, 502, 602 that have different opening layouts. For example, a container 602 may accommodate a first bezel 630 having a 3×4 opening 632 arrangement, but a second bezel (not illustrated) may additionally be provided having a different arrangement. For example, a bezel may include any number of large opening and a number of smaller openings positioned around the larger opening. The larger opening/openings may receive a cosmetic pan having a larger volume of cosmetic product, which may be beneficial for commonly used cosmetic products. The smaller opening or openings may receive cosmetic pans having a smaller volume of cosmetic product, which may be beneficial for specialty cosmetic products that do not require substantial quantities during use. In yet other examples, different bezels having desired arrangement of openings (e.g., an "X"-shaped layout, a "T"-shaped layout, etc.) may be provided. These different arrangements may assist users (e.g., makeup artists) with their workflow in applying the cosmetic product.

In yet other examples, the modular palettes described herein may not be provided with a bezel. In such examples, a magnetic insert may be disposed within the cavity to magnetically retain the cosmetic product pans therein. Such an arrangement would allow a user to place the cosmetic product pan within the cavity in an unrestricted, freeform manner. In still other examples, the modular palette may be provided without any magnetic insert. Rather, the container itself may be at least partially constructed from a magnetic material.

In the foregoing specification, specific examples have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described examples/implementations should not be interpreted as mutually exclusive, and should instead be understood as potentially combinable if such combinations are permissive in any way. In other words, any feature disclosed in any of the aforementioned examples/implementations may be included in any of the other aforementioned examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting example the term is defined to be within 10%, in another example within 5%, in another example within 1% and in another example within 0.5%. The term "coupled" as used herein is defined as connected, although not necessarily directly and not necessarily mechanically. A device or structure that is "configured" in a certain way is configured in at least that way, but may also be configured in ways that are not listed.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A modular cosmetic product comprising:

a container defining a cavity, the container being at least partially constructed from a magnetic material;

a bezel adapted to be at least partially disposed within the cavity of the container, the bezel including a magnetic element associated therewith, and the bezel including at least one opening; and a cosmetic product pan adapted to retain a cosmetic product, the cosmetic product pan at least partially disposed within the at least one opening of the bezel, the cosmetic product pan being at least partially constructed from a magnetic material such that the cosmetic product pan is urged towards the container or the bezel, wherein the bezel includes a continuous tapered ledge, an engaging portion, and a rear portion, the continuous tapered ledge configured such that a force directed into the cavity and exerted on the engaging portion causes the rear portion to move out of the cavity to facilitate removal of the bezel from the cavity of the container.

* * * * *